United States Patent [19]

Wilson

[11] 4,406,300

[45] Sep. 27, 1983

[54] ROOF SIPHON DRAIN

[76] Inventor: Edwin H. Wilson, 605 Dutch Valley Rd., Knoxville, Tenn. 37918

[21] Appl. No.: 226,440

[22] Filed: Jan. 19, 1981

[51] Int. Cl.[3] ..... F04F 10/00

[52] U.S. Cl. ..... 137/132; 137/124; 137/128; 137/135; 137/140; 137/142; 137/151; 137/357

[58] Field of Search ..... 137/124, 128, 132, 134, 137/135, 140, 142, 151, 357

[56] References Cited

U.S. PATENT DOCUMENTS

| | | | |
|---|---|---|---|
| Re. 28,491 | 7/1975 | Kundert | 137/142 |
| 831,817 | 9/1906 | Ackley | 137/148 X |
| 2,307,324 | 1/1943 | Larson | 137/357 |
| 2,313,855 | 3/1943 | Wiggins | 137/147 X |
| 3,757,812 | 9/1973 | Duncan | 137/142 |
| 4,059,126 | 11/1977 | Nickerson | 137/142 |
| 4,168,717 | 9/1979 | Rinker | 137/142 X |
| 4,171,706 | 10/1979 | Loftin | 137/142 X |
| 4,171,709 | 10/1979 | Loftin | 137/142 X |
| 4,248,258 | 2/1981 | Devitt et al. | 137/147 |

*Primary Examiner*—Gerald A. Michalsky

*Attorney, Agent, or Firm*—Pitts, Ruderman & Kesterson

[57] ABSTRACT

Apparatus for siphoning liquid such as water which accumulates in a ponding area (16) located on a flat roof (12) to a drain (14) is disclosed. The apparatus includes a first liquid conduit (21) which has one end (58) in the accumulated water and a second end (52) in drain (14). A reservoir (26) (64) accumulates a selected volume of water which is transferred from the reservoir (26) (64) by a second liquid conduit (38) to the first liquid conduit (21) such that the first liquid conduit (21) is completely filled with water suitable for initiating siphoning action of the water in ponding area (16) to drain (14). A means for controlling the flow of liquid from reservoir (26) (64) to first conduit (21) such as float valve (36) is included such that there is no transfer of liquid from reservoir 26 to first liquid conduit 21 until the selected volume of water has accumulated.

4 Claims, 11 Drawing Figures

ROOF SIPHON DRAIN

DESCRIPTION

1. Technical Field

This invention relates generally to a self actuating siphon drain system and more particularly to apparatus and methods for removing accumulated water from ponding areas on a flat roof by the use of a self priming siphoning system which does not require any electrical power or other energy source other than the precipitation of snow, sleet, hail or rain itself.

2. Background Art

The accmulation of water after the fall of rain, snow or other precipitation in undesirable areas always presents a drainage problem. However, the accumulation of water on the flat roof of a building often presents unusual problems. As is well known by those skilled in the art, the ponding and pooling of water accelerates the deterioration of roofing materials and along with the sun's ultraviolet rays represents one of the prime causes of deterioration of roofing materials.

It is standard practice in the design of a flat roof or building to include drains at selected locations on a roof. These drains are often carefully located such that when the building is first built they are at low points of the roof. If the drains remained at the low points of the flat roof, there would be little problem of water accumulation on a flat roof. Unfortunately, the top or highest point of the drain, which of course should be at the low point of the roof, usually remains substantially at its original level, while the roof itself because of loading often settles a substantial amount such that the other areas of the roof become the low points. In fact, it is not too unusual that the areas around the drain may be partially supported by the drain which is typically made of concrete, cast iron, or other rigid material such that these areas settle substantially less than the other portions of the roof and often become the "high point" on the flat roof. Of course in this situation, there will be extensive ponding and additional loading of water on the roof which results in the deterioration of the roofing materials discussed above.

To solve this problem, many techniques have been designed to remove water from a flat roof. For example, U.S. Pat. No. 3,692,040 issued to R. L. Kundert on Sept. 19, 1972 discloses a roof draining system that automatically siphons the water from roofs that are not completely self draining. The system includes a plurality of sumps. Extending from each of the sumps are siphon pipes which connect to a common discharge pipe. The common discharge pipe is primed by water under pressure such as provided by standard water service when water has accumulated to a selected level in the control sump. The control means of this device includes electrically controlled valves which prime the siphoning system by filling all of the pipes, drain pipes, etc. with water from the standard water service. Thus, the Kundert requires an elaborate installation which includes electrically controlled valves, piping necessary for the priming system, etc. Further, such a system requires the use of external power and a source of water under pressure to do the necessary priming.

Still another patent, U.S. Pat. No. 3,757,812 issued to J. E. Duncan on Sept. 11, 1973 also discloses apparatus suitable for draining standing water from low areas in a flat roof. The apparatus is enclosed in a housing which is located at the low area point of a roof such that as water accumulates on the roof surface, water will drain into the housing. Within the housing there is included a water pump which is activated by a float attachment when accumulated water reaches a predetermined level. The apparatus further includes valving means such that once a flow of the accumulated water has been moved by the pump to a drain pipe, a siphoning action will be initiated. After the siphoning action is initiated, the pump can be stopped and the remaining accumulated water removed soley by the siphoning action. The system further includes a heating unit to prevent the freezing of the floating mechanism or the pump. As was the case with the Kundert patent discussed earlier, electrical installation is also required. The use of electricity in close proximity to the accumulated water, of course, presents a safety hazard.

Still another roof draining system, is a solar powered roof drain provided by the General Products Division of the B. F. Goodrich Co. in Solan, Ohio. This drain operates on solar energy to create a pumping action to move the water from the pooling area to a suitable drain. Unfortunately, when there is heavy rain or other precipitation, the sun does not shine and therefore this unit is only effective after the precipitation has ceased, the clouds have cleared and the sun has appeared.

Still another system available is identified as the Waynco roof siphon pump from the Julian P. Benjamin Equipment Co. of Jacksonville, Fla. This system is simple in that only a siphoning action is necessary for removing the water from the roof. The pick up tube is located in the ponding area which runs to a drain. The control unit is located in the drain and collects water. Upon sufficient accumulation of water, the siphoning action is initiated. However, it will be appreciated as discussed heretofore the drain itself may be one of the highest points on the roof and thus there will often be little water flowing into the drain which can be used to initiate the siphoning action until after the roof is almost flooded. Thus, although this device does not use power and does operate on a siphoning system alone, it cannot be properly primed to initiate the siphoning action until the water level on the roof is sufficiently high to start draining into the provided drain.

Still other ways for removing water from a pooling area includes a device disclosed in U.S. Pat. No. 2,313,855 issued to J. H. Wiggins on Mar. 16, 1943 which is a device for removing accumulated water from the roof of a tank such as a gas storage tank. This patent uses the rising and falling of the tank top itself to power a pump system to initiate siphoning action. In addition, there is a U.S. Pat. No. 831,817 issued to G. D. Ackley on Sept. 25, 1906 for initiating a siphoning action to remove water from a cellar or basement. However, like some of the other previously discussed techniques, the technique of Ackley requires the siphoning system to be primed by an electrical pump and further requires the use of check valves to assure the operation of the system. Thus, it can be seen that there have been no suitable techniques to date which are both inexpensive and efficient at removing the accumulation of water in ponding areas on a flat roof.

Therefore, it is an object of the present invention to provide a simple and inexpensive technique for removing accumulated water on a flat roof.

It is still another object of this invention to provide methods and apparatus for removing water from pooling areas on a flat roof which does not require the use of an external power source.

It is yet another object of the present invention to provide methods and apparatus for removing accumulated water from any selected area of a flat roof upon the occurrence of a selected amount of precipitation.

DISCLOSURE OF THE INVENTION

Other objects and advantages will in part be obvious and will in part appear hereinafter and will be accomplished by the present invention which provides apparatus and methods for siphoning liquid such as water which accumulates in a ponding area located at a first level such as a flat roof to a second level lower than the first level such as into a drain. The apparatus comprises a first liquid conduit having a receiving end terminating in the accumulated liquid in the ponding area, and a discharge end terminating in the drain at a selected level below the receiving end. Also included is a reservoir located above the terminating end of the first liquid conduit for accumulating a selected volume of liquid. A second liquid conduit having an upper end and a lower end extending between the reservoir and the first liquid conduit provides a flow path for liquid from the reservoir. The apparatus includes a means for controlling the flow of the selected volume of liquid from the reservoir such that a siphoning action to move any accumulated liquid in the ponding area through the first liquid conduit to the drain is initiated. In a first embodiment, the second liquid conduit is connected between the reservoir and an intermediate location along the first liquid conduit between the receiving end and the discharge end. In this first embodiment, the means for controlling comprises a valve such as a float valve which prevents the flow of liquid from the reservoir through the second liquid conduit until the liquid in the reservoir accumulates to the selected level. Thus, when the valve opens, at least the portion of the first liquid conduct between the intermediate location and the drain is filled with liquid such that the necessary siphoning action is initiated.

BRIEF DESCRIPTION OF THE DRAWINGS

The above mentioned features of the present invention will be more clearly understood from the consideration of the following description in connection with the accompanying drawings in which.

BEST MODE FOR CARRYING OUT THE INVENTION

Figure 1:
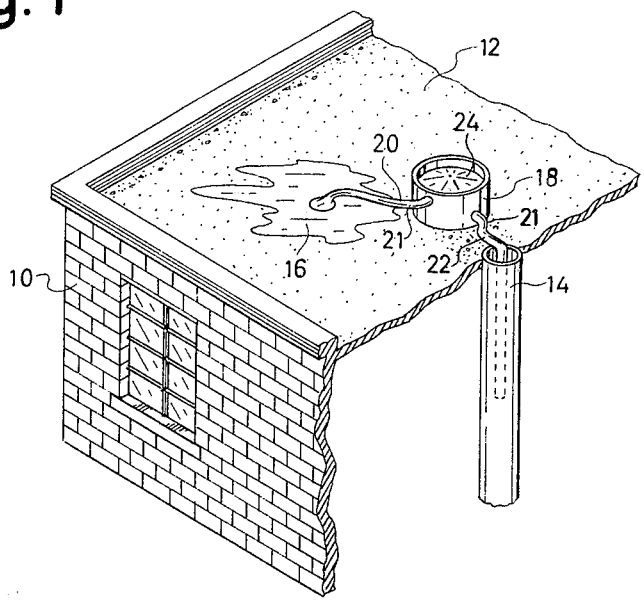
FIG. 1 is a partial pictorial diagram of an embodiment of the siphoning draining system of this invention suitable for locating adjacent a ponding area on a flat roof.
Figure 2:
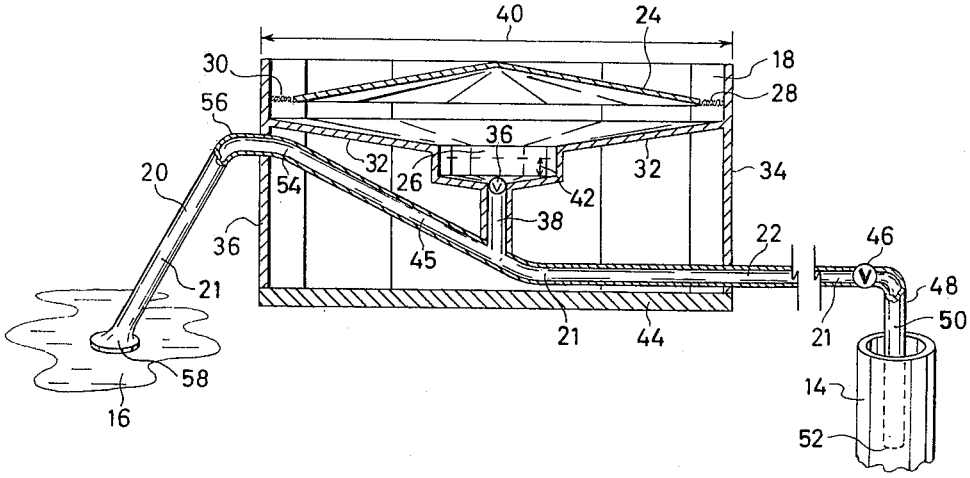
FIG. 2 is a cross-section of the apparatus shown in FIG. 1 showing the accumulating reservoir and water conduits for initiating the automatic siphoning action of this invention.

Referring now to FIG. 1, there is shown a building 10 having a flat roof 12 with a roof drain 14. As shown, there is also an accumulation of water or pool of water 16 which is not draining into drain 14. Also shown is an embodiment of the present invention including enclosure 18 located adjacent ponding area 16 with a first portion 20 of a first water conduit 21 leading from the enclosure 18 into the pond of water 16. Also included is a second portion 22 of the first water conduit 21 leading from enclosure 18 to roof drain 14. As is further shown, enclosure 18 includes a cover 24 to prevent the introduction of debris and other foreign matter into a reservoir (not shown) to be discussed hereinafter located in the interior of enclosure 18. Referring now to FIG. 2, there is shown a cross-sectional view of enclosure 18 and portions 20 and 22 of the first water conduit 21. As is shown, enclosure 18 includes an internal reservoir 26 which is covered by cover 24. In a particular embodiment, cover 24 includes screens at the circumferential edges such as indicated at 28 and 30 for preventing the introduction of foreign material or debris onto the collecting pan 32. As seen, collecting pan 32 slopes from the circumferential edges indicated at 34 and 36 of the enclosure 18 to the reservoir 26. Thus, it will be appreciated that rainfall falling on top of cover 24 will eventually find its way into reservoir 26. Reservoir 26 further includes valving means 36 which is typically in a normally closed position such that water accumulating in reservoir 26 cannot pass into a second water conduit 38. As will become clear hereinafter, the diameter of reservoir 26 as indicated by arrow 40 provides a surface area exposed to falling rain and other precipitation such that as an example a rainfall of one quarter ($\frac{1}{4}$) inch will result in an accumulation of water in reservoir 26 considerably greater than one quarter ($\frac{1}{4}$) inch. That is, by proper selection of the diameter or surface area exposed to the falling rain with respect to the cross-sectional area of reservoir 26, the selected amount of rainfall can result in a selected depth or accumulation of water in reservoir 26 as is indicated by arrow 42 which may be substantially greater than the rainfall. As shown in the instant case, there is a ballast 44 also included at the bottom of enclosure 18 to prevent the enclosure from being moved around by high winds. It will also be appreciated, of course, that the enclosure 18 may be made of any suitable material, such as plastic or metal, but a particular satisfactory material is polyvinyl chloride which is inexpensive and which is not vulnerable to deterioration by the rain or ultraviolet rays of the sun. Also as shown, portion 20 of the first water conduit 21 leads from a ponding area 16 on the roof to enclosure 18. As can be seen in this embodiment, the first portion 20 of the water conduit 21 passes into enclosure 18 at a level above the level of reservoir 26 and then slopes down below reservoir 26 where second water conduit 38 connects therewith. It will be appreciated, of course, that although portion 20 of the water conduit 21 is shown entering enclosure 18 above the level of reservoir 26, the water conduit may enter enclosure 18 at any lower level of the enclosure. However, if water conduit does enter at a lower level the use of a one way valve such as shown at 46 will aid in the operation of the system by preventing a back flow of water. The water path further continues out through enclosure 18 and exits substantially at the bottom of enclosure 18 as portion 22 of the water conduit 21. Portion 22 of the water conduit 21 extends to point 48 which is located substantially at the top of drain 14. First water conduit 21 continues beyond point 48 by means of a vertical portion 50 which extends in the drain 14 a selected distance to lower end 52.

Thus, there has been described to this point, apparatus for automatically siphoning water from a ponding area on a flat roof into a drain. The apparatus operates as follows. During a rainfall, water falling on cover 24 eventually finds its way into reservoir 26. As the rainfall continues, the level of water in reservoir 26 will continue to increase to a preselected level such that a predetermined volume of water is contained in reservoir 26. When the preselected level is reached, float valve 36 will open thereby dumping the selected volume of water in reservoir 26 into second water conduit 38. The volume of water in reservoir 26 is selected such that this volume is sufficient to at least completely fill portion 22 and the vertical portion 50 located in drain 14 of the first water conduit 21. This water flowing through the first water conduit 21 creates a suction or negative pressure in portion 54 of portion 20 such that water standing in ponding area 16 is drawn up through portion 20 above the highest point of the water conduit as indicated by reference number 56 such that it starts flowing down portion 54. The falling water which was introduced into the water conduit from reservoir 26 moving through vertical section 50 and out end 52 is sufficient to draw the water from ponding area 16 on into the vertical portion 50 such that the level of water from ponding area 16 in vertical portion 50 is below the ponding area 16. It will also be appreciated that once the water in reservoir 26 has been completely or partially drained, valve 36 will again close thereby sealing second water conduit 38 so that no further air or water may enter the conduit from reservoir 26. It will also be appreciated by those skilled in the art that once water from ponding area 16 which has filled the first water conduit 21 reaches a level lower than the level of the ponding area the siphoning action will be continued by the flow of water through vertical portion 50. Once the siphoning action is initiated, complete draining of the accumulated water in ponding area 16 will be accomplished by the siphoning action until receiving end 58 of portion 20 is uncovered and allows the introduction of air thereto. It will be appreciated, of course, that the embodiment discussed above as well as other embodiments to be discussed hereinafter could be used for liquids other than water, and references to water in these discussions are not to be considered as limitations to the scope of this invention except as is set forth in the claims.

Thus, there has been disclosed and discussed a technique for initiating a siphoning action to remove accumulated water from a ponding area on a flat roof to a drain which requires no other energy than the falling precipitation itself. A specific example of the above discussed siphoning draining system which has been found to be particularly useful and which activates when approximately a quarter inch of rain falls upon cover 24 will now be discussed. In this embodiment, the diameter 40 of enclosure 18 is approximately 26 inches and the inside diameter of the first water conduit 21 is 0.5 inches, and the length is 50 feet. The reservoir 26 has a diameter selected at approximately ten inches such that when the selected volume of water has accumulated, the height of the water as indicated by arrow 42 is approximately 1.65 inches. Thus, it will be appreciated that with these dimensions there will be accumulated sufficient water in the reservoir 26 to more than completely fill the first water conduit 21 between the intermediate location at which second water conduit 38 joins conduit 21 and drain 14 as is necessary to initiate the siphoning action such that the water will be drawn from ponding area 16 into drain 14.

Figure 3:
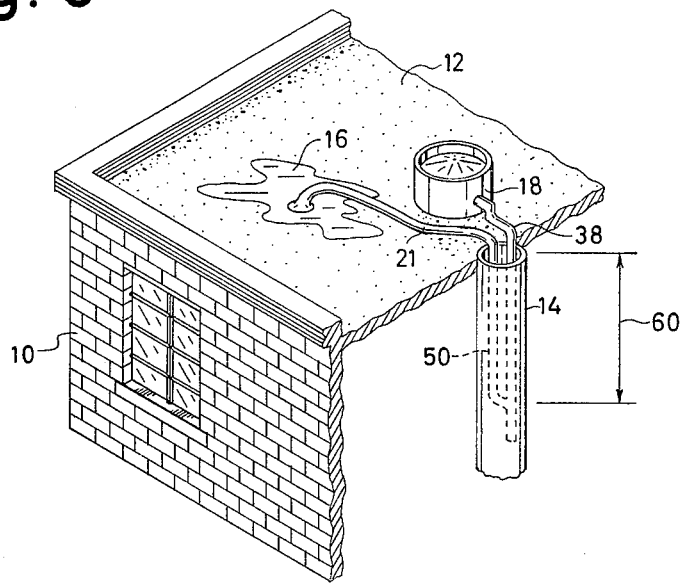
FIG. 3 illustrates another embodiment of the present invention wherein the siphoning action to remove water from a ponding area is initiated by aspiration action.

Referring now to FIG. 3, there is shown a second embodiment of the present invention. Similar portions of the invention to that discussed with respect to FIG. 1 will retain the same reference numbers. However, as is shown, water conduit 21 leading from ponding area 16 (instead of going through enclosure 18) goes directly into drain 14 and to a vertical portion 50 of conduit 21 which is located inside of drain 14 at a selected level below ponding area 16 as is indicated by arrow 60. In addition, water conduit 38 leading from enclosure 18 joins vertical portion 50 in drain 14.

Figure 4:
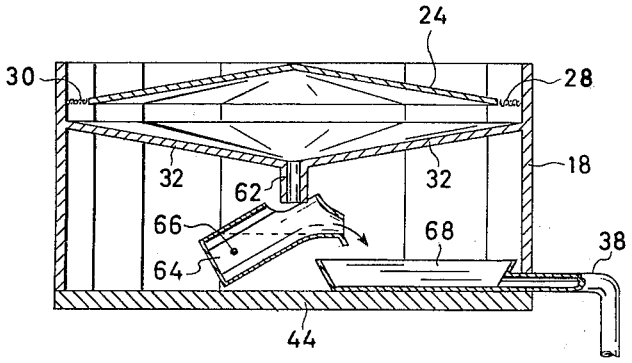
FIG. 4 illustrates an embodiment of the present invention having a pivoting reservoir suitable for beginning the aspiration action as shown in FIG. 3, and suitable for use with the embodiment of FIG. 5.

Referring now to FIG. 4, there is shown a cross-section of a portion of the apparatus for activating the siphoning action of the technique of FIG. 3. As shown, water falling on cover 24 of the enclosure 18 is routed into conduit 62. Instead of a fixed reservoir 26 as was discussed with respect to FIG. 2, the water from pan 32 drains into a collecting tank 64 which is pivotally mounted on pivot 66 such that when the selected amount of water accumulates in collecting tank 64 the tank pivots around pivot 66 and dumps the water into receiving tank 68. Pivoting collecting tank 64 is designed such that once the collecting tank 64 pivots over center it will remain in the dumping position until all of the water contained therein is removed. Once the water is completely dumped from collecting tank 64 the tank again pivots around pivot 66 back to its original position for collecting additional water from conduit 62. The water dumped into receiving tank 68 immediately flows through second conduit 38. In the embodiment shown in FIG. 3, second conduit 38 is routed into drain 14 where it connects at a selected distance below ponding area 16 with the vertical portion 50 of first water conduit 21. The connection of water conduit 38 to vertical portion 50 is a water tight and air tight connection. Thus, as water flows out of receiving tank 68 into conduit 38, and past vertical portion 50, negative pressure is introduced by aspiration action into first water conduct 21, such that water which has accumulated in pooling area 16 is drawn into first water conduit 21 over the edge of drain 14 and into vertical portion 50 where it is then emptied into drain 14. Once the water from ponding area 16 filling conduit 21 has been drawn to a level below ponding area 16 it will be appreciated that the siphoning action will be initiated such that all the water which has accumulated in ponding area 16 will be moved by siphoning action into drain 14. This siphoning action will, of course, continue until the receiving end 58 of water conduit 21 is uncovered and allows the introduction of air.

Figure 5:
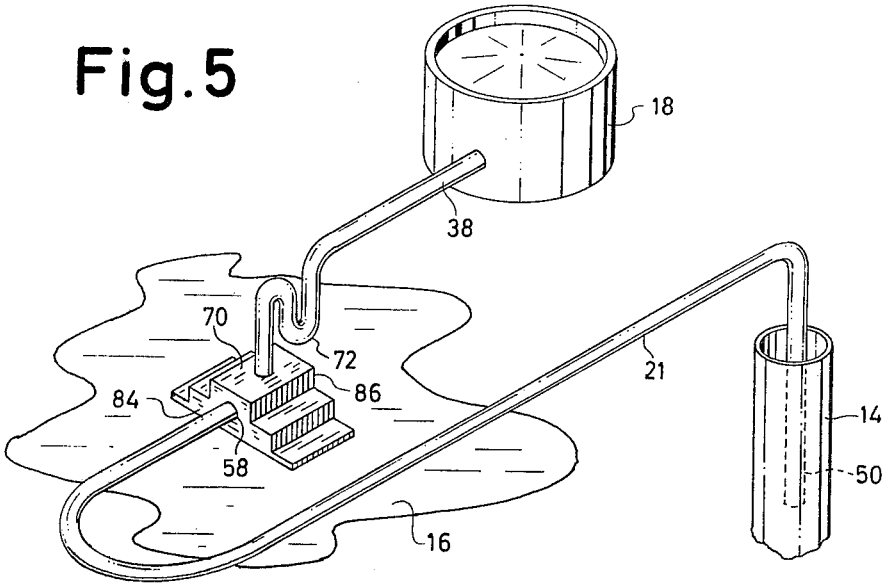
FIG. 5 shows still another embodiment of the present invention for initiating the siphoning action.
Figure 6:
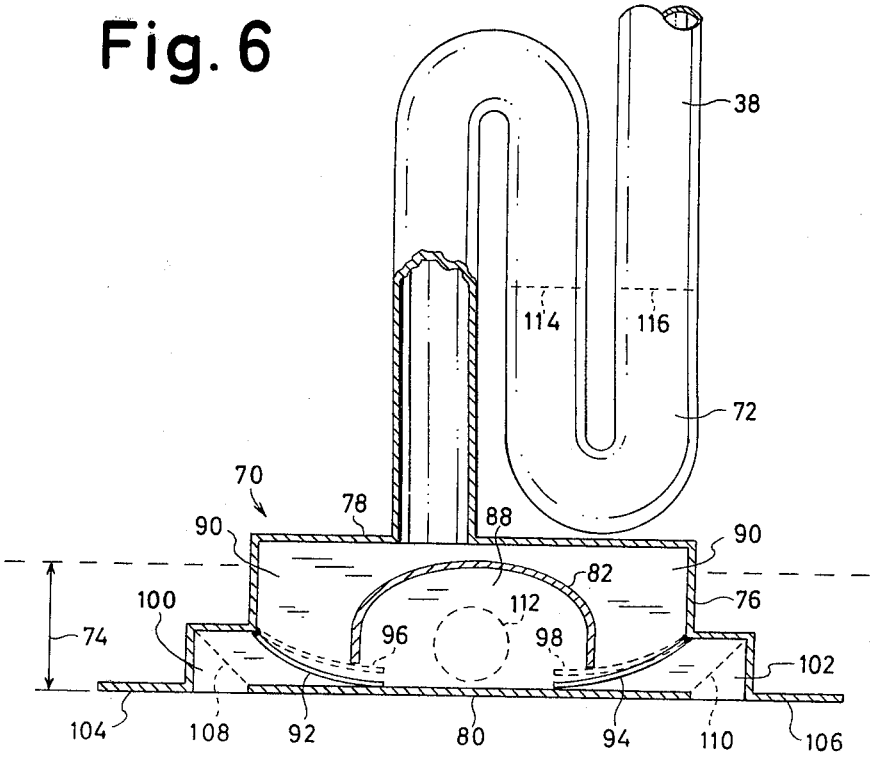
FIG. 6 illustrates a cross-section of the valve unit of the embodiment of FIG. 5.

Another embodiment of the present invention which uses a pivoted collecting tank is disclosed in FIGS. 4, 5, and 6. As shown in the pictorial view of FIG. 5, second water conduit 38 joins first water conduit 21 at the receiving end 58 in ponding area 16 by means of a valve unit 70 rather than at the vertical portion 50 inside of drain 14. The operation of the pivoting collecting tank 64 of FIG. 4 is the same as discussed above, except that the flow of water through second water conduit 38 is to valve unit 70. Referring now to FIG. 6, there is shown the operation of control unit 70. As shown when pivoting collecting tank 64 dumps the collected water into tank 68 the rush of water through second water conduit 38 is carried through the "S" shaped water valve 72 into valve unit 70. As shown, water has collected into the pond area 16 around control unit 70 up to a level as is indicated by arrow 74. Valve unit 70 includes a housing 76 with a water tight connection to second water conduit 38 at top 78 such that water in second water conduit 38 will flow to the interior of housing 76. Housing 76 includes a base plate 80 which rests on the roof surface and which along with baffle 82 and sides 84 and 86 of housing 76 defines a chamber 88 such that water from second conduit 38 will flow into exterior chamber 90, past flapper valves 92 and 94 and through slit apertures 96 and 98 when valves 92 and 94 are in the lower position shown by the solid lines. Housing 76 also defines two water entry chambers 100 and 102. Thus, it will be appreciated that water ponding area 16 can flow under flanges 104 and 106 of base plate 80 into chambers 100 and 102, past filter screens 108 and 110, flapper valves 92 and 94 (when these valves are in the upper position as indicated by dashed lines) through slit apertures 96 and 98 and on into chamber 88. Also, as can be seen from FIG. 5 and as is indicated by dashed line 112, first water conduit 21 includes a water tight connection to chamber 88 such that water in chamber 88 can flow through first water conduit 21 to drain 14.

Operation of this embodiment is as follows. As water accumulates in pond area 16, flapper valves 92 and 94 which are flexible will tend to float on top of the water and as the ponding water gets deeper, move to the upper position indicated by the dashed lines and thereby provide a water flow path from chambers 100 and 102 through slit apertures 96 and 98 and on into chamber 88. However, it will be appreciated that water is also accumulating in collecting tank 64. Thus, when the water in collecting tank 64 accumulates to the selected level the tank pivots and water is dumped into receiving tank 68 as was discussed heretofore. The water then flows rapidly from receiving tank 68 through second water conduit 38 and "S" shaped water valve 72 into outer chamber 90. The sudden rush of water fills the outer chamber 90 and forces flapper valves 92 and 94 to the lower position so that the water can flow on into inner chamber 88 without adding more water to ponding area 16. The volume of water from receiving tank 68 through second water conduit 38 is selected to be sufficient to completely fill inner chamber 88, and all of first water conduit 21 including the vertical portion 50 which extends into drain 14. Therefore, once first water conduit 21 is full of water and no more water is being dumped into outer chamber 90 flapper valves 96 and 98 return back to the position indicated by dotted lines. Thus, a siphoning action to move the water which has accumulated in ponding area 16 is initiated by the water flowing through first water conduit 21. This siphoning action continues until the accumulated water is reduced to such a low level that air can enter the system under flanges 104 or 106. It will be appreciated that although flapper valves 92 and 94 will typically be sufficient to prevent any air flow from second water conduit 38 into the system during the siphoning action, "S" shaped water valve 72 will assure that water tight seal by means of the plug of water indicated by dotted lines 114 and 116 in valve 72.

Figure 7:
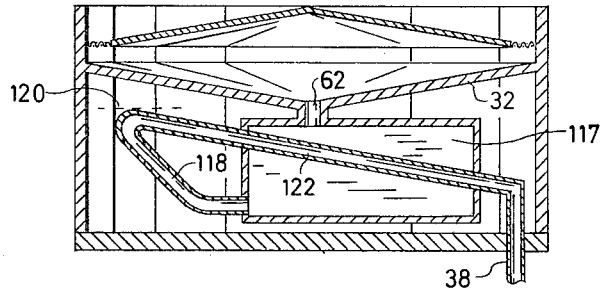
FIG. 7 illustrates still another embodiment of this invention for beginning an aspiration action to initiate the siphoning action as indicated in FIG. 3.

Still another embodiment of the present invention is disclosed in FIG. 7. As shown in this embodiment, the removal of water from ponding area 16 into the drain by the siphoning action is initiated by the aspiration action of water moving through vertical position 50 of first water conduit 21. This aspiration action operates essentially the same as discussed with respect to FIG. 3 above and will not be discussed further. However, to obtain the flow of water necessary to initiate the aspiration, a different technique illustrated in FIG. 7 is used.

As shown, and as was true in the embodiment of FIG. 4, precipitation falling on cover 24 runs down sloping pan 32 into conduit passage 62. However, in this embodiment the reservoir 117 does not pivot as was in the case of FIG. 4. Instead reservoir 117 has a selected volume such that the preselected amount of water can be accumulated. At substantially the bottom of reservoir 117 a conduit 118 rises with a gradual slope to a selected level 120 which is above the top of reservoir 117. Connected to rising conduit 118 is a gradually downward sloping conduit 122, which joins in a water tight connection to second water conduit 38. Thus, it will be appreciated that as water accumulates in reservoir 117 and continues to accumulate above level 120, conduit 118 will also fill with water. Once the water reaches the level of 120 which is the top of conduit 118, the water will begin to move down water conduit 122. Since air cannot enter into conduit 122 through conduit 118, if air is to enter into conduit 122 it must be by way of second water conduit 38. It will be appreciated, of course, without the discharge of air displaced by the water moving down conduit 122, the water could not move. It will also be appreciated, that if conduit 122 could be completely filled with water until the water moved down to a point below the bottom level of reservoir 117 then a siphoning action would be initiated with respect to the water accumulated in reservoir 68. However, as was discussed above, in a typical situation the air would move through the conduit 38 to replace water in conduit 122 thereby preventing conduit 122 from being completely filled with water. However, referring now to FIG. 8 there is shown a valving means 124 which is located in conduit 122 at a location below the lowest point of reservoir 117. As shown, this valve 124 is balanced such that it tends to be in the normally closed position. However, the balance is such that it normally would take very little force to move from the normally closed position to the normally open position. As seen in the particular embodiment, the valve pivots at point 126. Also as shown, there is a ridge 128 such that the lip 130 of valve 124 rests against the front portion of ridge 128 in the closed position and will be maintained in such a closed position by ridge 128. However, the lip 130 of butterfly valve 124 is flexible in a direction indicated by arrow 136 but somewhat less flexible in a direction indicated by arrow 138. Thus. although the butterfly valve 124 will easily close and pass ridge 128 in the direction necessary to close the valve, once in the closed position a substantially greater amount of force will be necessary to push lip 130 of valve 124 past ridge 128 into the open position. Thus, it will be appreciated that as water tends to flow down water conduit 122 it will be prevented from continuing further by butterfly valve 124 such that the water will continue to back up in conduit 122 and against butterfly valve 124, and slowly fill conduit 122. The flexibility of water butterfly valve 124 is selected such that once the water level flowing into reservoir 117 reaches a predetermined height the force on butterfly valve 124 will be sufficient to force the valve pass ridge 128 and into the open position thereby allowing the water to flow on into second water conduit 38 to initiate the necessary siphoning action. Also, as was discussed heretofore with respect to FIG. 3, once the flow of water is initiated through second water conduit 38 such that an aspiration action produces a negative pressure in first water conduit 21, the siphoning action of water from pooling area 16 into drain 14 will be initiated. This siphoning action as was discussed before will completely remove the accumulated water from the ponding area 16.

Figure 8:
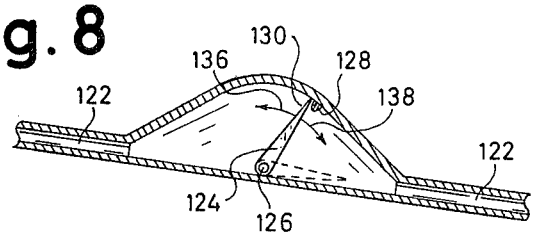
FIG. 8 illustrates a first technique for controlling the operation of the embodiment in FIG. 7.
Figure 9A:
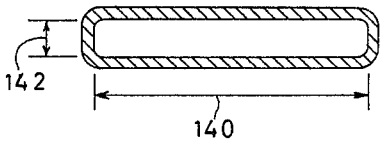
FIGS. 9A and 9B illustrate a second technique for controlling the aspiration action of the device of FIG. 7.
Figure 9B:
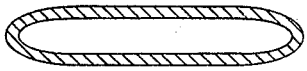

In addition to the butterfly valve technique discussed with respect to FIG. 8, a second technique may be used to ensure the complete filling of conduit 122. Referring now to FIGS. 9A and 9B there are shown two possible cross-sectional areas of conduit 122. As shown, a conduit 122 having this type cross-section includes a very long inside dimension 140 and a very short inside dimension 142. Short dimension 142 is selected such that as water moves up the conduit 118 and then passes into conduit 122 the surface tension of water is sufficient to maintain the water in full contact with the inside surface of conduit 122. Thus, as the water moves down conduit 122, the surface tension of the water will cause the water to maintain contact with the inside circumference of the conduit such that the leading face of the water as it moves down the conduit will not allow air to pass. Thus, the water continues to move down the conduit 122 until it reaches a point below the bottommost level of reservoir 117 and initiates the siphoning action. Initiation of the siphoning action will increase the speed of the water through conduit 122 and into second water conduit 38 such that the water through conduit 122 and into second water conduit 38 will generate the necessary aspiration action to initiate siphoning action of accumulated water from ponding area 16. Thus, in this particular embodiment there is no requirement of any moving parts whatsoever.

Figure 10:
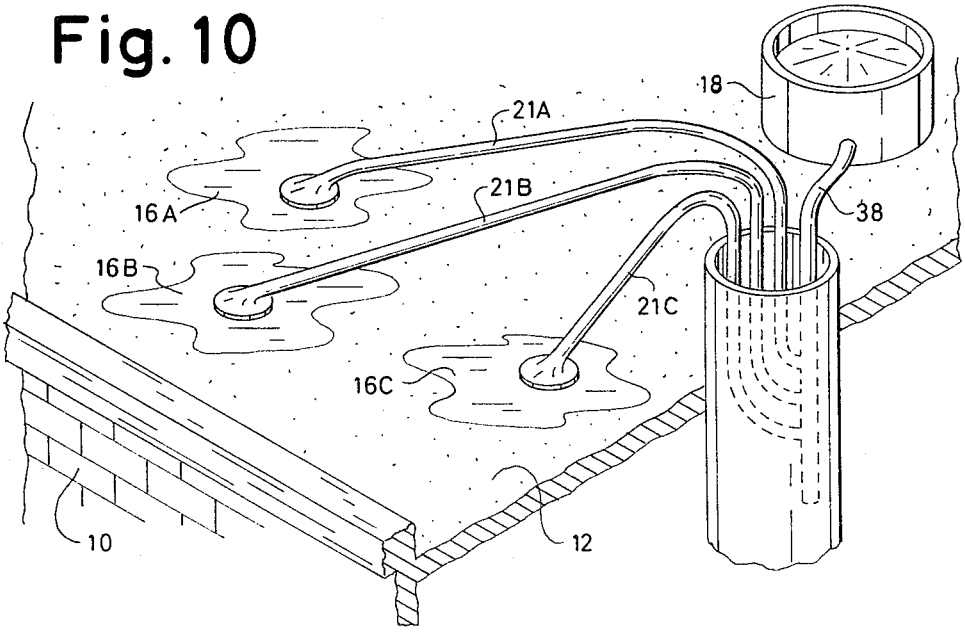
FIG. 10 illustrates a multiplicity of siphoning lines through which the siphoning of ponding water at various locations is initiated by aspiration action in a manner shown in FIG. 3.

Referring now to FIG. 10, there is shown how the device disclosed in FIG. 3 may include a multiplicity of water conduits leading from various ponding areas. All that is necessary for the water flow to start the aspiration action in the various conduits which in turn starts the siphoning action is that sufficient space be maintained between the connection points of water conduits 21.

Thus, although the present invention has been described with respect to specific methods and apparatus for providing a roof siphon drain which does not use an external energy source, it not intended that such specific references be considered limitations upon the scope of this invention except insofar as is set forth in the following claims.

I claim:

1. Apparatus for siphoning liquid which accumulates in a ponding area located at a first level to a second level lower than said first level in a drain means comprising:

a first liquid conduit having a receiving end and a discharge end, said receiving end of said first liquid conduit terminating at a valve unit and said discharge end terminating in said drain at said second level located a selected distance below said receiving end;

a second liquid conduit having an upper end terminating at a receiving tank and a lower end terminating at said valve unit;

a reservoir for accumulating a selected volume of liquid at least sufficient to completely fill said first liquid conduit, said reservoir being located at a level above said discharge end of said first liquid conduit, and being pivotally mounted and balanced such that when said selected volume of liquid has accumulated, said reservoir will pivot and dump said selected volume of liquid;

said receiving tank located below said reservoir, and said receiving tank being connected to said upper end of said second liquid conduit with a liquid tight connection so that said selected volume of liquid will flow through said second liquid conduit; and said valve unit located in said accumulated liquid in said ponding area and having a liquid tight connection with said receiving and of said first liquid conduit and said lower end of said second liquid conduit, said valve unit having a first operating position for providing a first liquid path between said accumulated liquid in said ponding area to said receiving end of said first liquid conduit, and said valve unit being suitable for switching to a second operating position when said selected volume of liquid is dumped from said reservoir to said receiving tank such that said first liquid path is closed and a second liquid path is provided between said lower end of said second liquid conduit and said receiving end of said first liquid conduit such that said dumped liquid flowing through said second liquid conduit completely fills said first liquid conduit to initiate a siphoning action between said receiving end and said discharge end of said first liquid conduit, said valve unit switching back to said first operating position after said siphoning action is initiated to move liquid accumulated in said ponding area through said first liquid conduit to said drain means.

2. The apparatus of claim 1 and further including a liquid valve in said second liquid conduit between said reservoir and said valve unit to prevent air from entering said valve unit from said reservoir.

3. The apparatus of claim 1 wherein said apparatus is suitable for removing ponding water from a roof, and wherein said reservoir may be moved to selected locations on said roof.

4. The apparatus of claim 3 and wherein said reservoir further includes a selected surface area for collecting precipitation such that when precipitation of water or snow reaches a preselected amount, the accumulated amount of water in said reservoir will be at said selected water level.

* * * * *